United States Patent [19]

Santiago

[11] Patent Number: 5,070,619

[45] **Date of Patent: * Dec. 10, 1991**

[54] GUNSIGHT

[76] Inventor: Julio A. Santiago, 13713 Susan La., Burnsville, Minn. 55337

[ * ] Notice: The portion of the term of this patent subsequent to Apr. 24, 2007 has been disclaimed.

[21] Appl. No.: 600,176

[22] Filed: Oct. 19, 1990

Related U.S. Application Data

[63] Continuation of Ser. No. 441,621, Nov. 27, 1989, abandoned, which is a continuation-in-part of Ser. No. 214,726, Jul. 1, 1988, Pat. No. 4,918,823, which is a continuation-in-part of Ser. No. 145,030, Jan. 9, 1988, abandoned.

[51] Int. Cl.[5] ..... F41G 1/00

[52] U.S. Cl. ..... 33/242; 33/233

[58] Field of Search ..... 33/233, 234, 261, 241, 33/244, 243, 245, 242; 42/100, 102, 103

[56] References Cited

U.S. PATENT DOCUMENTS

| | | | |
|---|---|---|---|
| 837,563 | 12/1906 | Hartmann | 33/243 |
| 1,174,063 | 3/1916 | Frank | 33/233 |
| 1,225,592 | 5/1917 | Borgo | 33/241 X |
| 1,363,553 | 12/1920 | Barringer . | |
| 1,718,458 | 6/1929 | Hager et al. . | |
| 1,851,189 | 3/1932 | King | 33/243 |
| 2,706,335 | 4/1955 | Munsey | 33/241 |
| 3,028,674 | 4/1962 | Luebkeman | 33/243 |
| 3,386,171 | 6/1968 | Luebkeman . | |
| 3,698,091 | 10/1972 | Merrill et al. . | |
| 3,698,092 | 10/1972 | Rosenhan . | |
| 3,984,917 | 10/1976 | Korzeniewski | 33/244 X |
| 4,375,725 | 3/1983 | Orlob | 33/241 X |
| 4,663,878 | 5/1987 | Beretta . | |
| 4,679,344 | 7/1987 | Jolly . | |
| 4,713,889 | 12/1987 | Santiago . | |

FOREIGN PATENT DOCUMENTS

| | | |
|---|---|---|
| 665662 | 6/1939 | Fed. Rep. of Germany . |

*Primary Examiner*—Harry N. Haroian
*Attorney, Agent, or Firm*—Jacobson & Johnson

[57] ABSTRACT

A gunsight for a weapon including a channel sight with a sight post located on one end of the channel with one embodiment of the gunsight having a sight post with an opening for receiving an insert that has a contrasting color from the target the user intends to shoot at.

1 Claim, 8 Drawing Sheets

GUNSIGHT

This application is a continuation of application Ser. No. 441,621, filed Nov. 27, 1989, now abandoned, which is a continuation-in-part of application Ser. No. 214,726 filed Jul. 1, 1988, now U.S. Pat. No. 4,918,823, which was a continuation-in-part of application Ser. No. 145,030 filed Jan. 19, 1988, now abandoned.

FIELD OF THE INVENTION

This invention generally relates to gunsights and, more particularly, to a gunsight that can be rapidly aimed with both eyes open thus eliminating the need for the user to close one eye and locate the gunsight and the target with the gunsight having a front sight post for holding inserts of colors that contrast with the background of a target.

DESCRIPTION OF THE PRIOR ART

My U.S. Pat. No. 4,713,889 discloses an illuminated gunsight for mounting on a weapon to permit the user to aim and shoot in both daytime conditions and low-light conditions. The sighting device includes a U-shaped channel with a pair of fluorescent lines located along the bottom of the sighting channel. The fluorescent lines act as a quick reference to enable the user to quickly sight in on the target. In the daytime use of the gunsight shown in my patent, the user's eye is first drawn to the fluorescent lines followed by the user peering through the channel to locate the target.

My present invention also uses a U-shaped channel with sighting lines to enable the user to even more quickly aim a weapon. Briefly, the present invention utilizes the sighting surfaces on the topmost surfaces of the sight so that the eye does not have to search in the channel for the fluorescent sighting lines. That is, with the sight shown in my patent, if the weapon is not in initial alignment with the target the user only sees a portion of the fluorescent sighting strips. With my present invention the user immediately sees the location of the entire sighting surfaces even if the weapon is not in alignment with the target, since the sight lines are on top of the sighting channel. For example, if the user has to rotate the weapon to get the sights into initial alignment, the user can readily do so since the sighting surfaces are located on top of the sighting channel and thus readily visible to the user because the sighting surfaces are not obscured by the sidewalls of the gunsight.

The present invention further differs from the sighting device shown in my U.S. Pat. No. 4,713,889 in the manner of location of the gunsight. The gunsight shown in my patent mounts along the entire length of the barrel of a hand gun or revolver whereas the present invention can be mounted on the portion of a semi-automatic pistol slide in front of the ejection port, yet still provide an accurate sight. The present invention can also be adapted to revolvers and hand-held weapons.

The present invention includes a front sight post with an opening therein where the user can exchange colored inserts to provide the sight post with a color that contrasts with the target.

The Beretta U.S. Pat. No. 4,663,878 shows a channel sight with front and rear sight posts extending into the channel to provide a sight line for the user.

The Korzeniewski U.S. Pat. No. 3,984,917 shows a channel sight with elevated front sight posts to be used with the rear sight on the weapon.

The Luebkeman U.S. Pat. No. 3,028,674 shows a sight that includes a front sight post that extends across the channel on the top of the weapon.

The Luebkeman U.S. Pat. No. 3,386,171 shows a gunsight with a tapered channel as a rear sight and a front sight post located in front of the channel. The channel includes three internal extending dividers.

The Rosenhan U.S. Pat. No. 3,698,092 shows an illuminated gunsight with use of separate channel sights on the front and rear of the weapon together with conventional sights located adjacent the channels.

The Merrill U.S. Pat. No. 3,698,091 shows a sight similar to the Rosenhan sight.

The Barringer U.S. Pat. No. 1,363,553 shows a sight with a bright strip to guide the users eye to the sight.

The Jolly U.S. Pat. No. 4,679,344 shows a pistol with a luminescent material so as to be visible in low light conditions.

The Hager, et, al. U.S. Pat. No. 1,718,458 shows a channel type sides where the sides converge toward the front of the sight.

The German patent 665662 shows a flared sight post with a luminous material on the sight post.

BRIEF DESCRIPTIONS OF THE DRAWINGS

FIG. 18 shows a sight picture with a disposable insert having a color that contrasts with the target the user is shooting at;

BRIEF SUMMARY OF THE INVENTION

Briefly, the present invention comprises a gunsight having a pair of parallel light reflecting surfaces located at the topmost portion of the gunsight surface to enable the user to initially align the gunsight with a target while both eyes are open with the sight post having an insert to permit the user to have either a solid sight post of one color or a sight post with a colored insert that contrasts with the target.

DESCRIPTION OF THE PREFERRED EMBODIMENT

Figure 1:
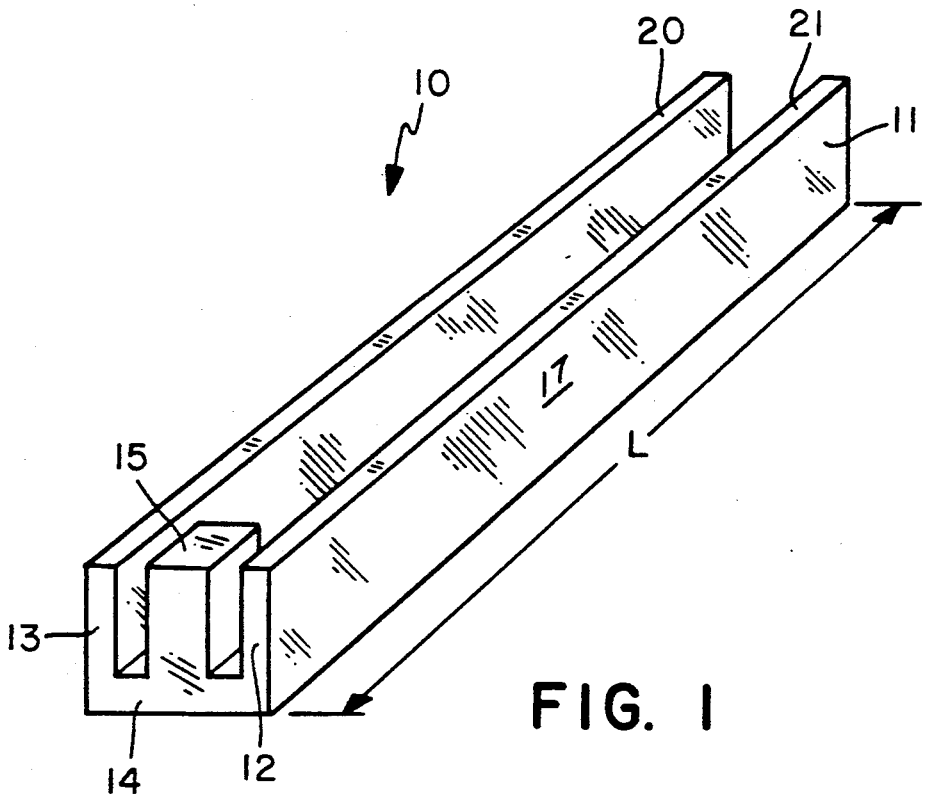
FIG. 1 is a perspective view of my sighting device for mounting on top of a weapon.

Referring to FIG. 1 reference numeral 10 identifies my channel sight for mounting on a pistol or handgun. My sight comprises a U-shaped channel 11 formed by a first rectangular shaped sidewall 12, a bottom section 14 and a second rectangular shaped sidewall 13. Located on top of sidewall 12 is a light reflecting surface 21 and located on top of sidewall 13 is a light reflecting surface 20 which is parallel to light reflecting surface 12. Light reflecting surfaces 12 and 13 are located on the topmost portion of sight 10 and provide prominent surfaces that contrast with the handgun to permit a user to quickly aim the weapon in daylight conditions without the user closing one eye. That is, the heavy light reflecting parallel lines 20 and 21 vividly contrast with the dark background of the handgun and almost immediately permit the user to line up the target with the parallel line sights on the weapon. Typically, the light reflecting surfaces may be a polished metal surface or a fluorescent surface that vividly contrasts with the top of the gun and the rest of the gunsight. Once the user has aligned the target with the parallel light reflecting lines, the predominant eye of the user automatically permits the user to align the sight post 15 with the target. Even if the user's nondominant eye is open during the sighting process, the sidewall of the channel sight shields the view for the nondominant eye, thus preventing the user from seeing a double image. Consequently, the user can aim and shoot a weapon without having to close one eye and without having to search for the sights on the front and back of the weapon since the sight lines on the top of the gunsight quickly direct the user's sight picture into the sighting channel.

Figure 2:
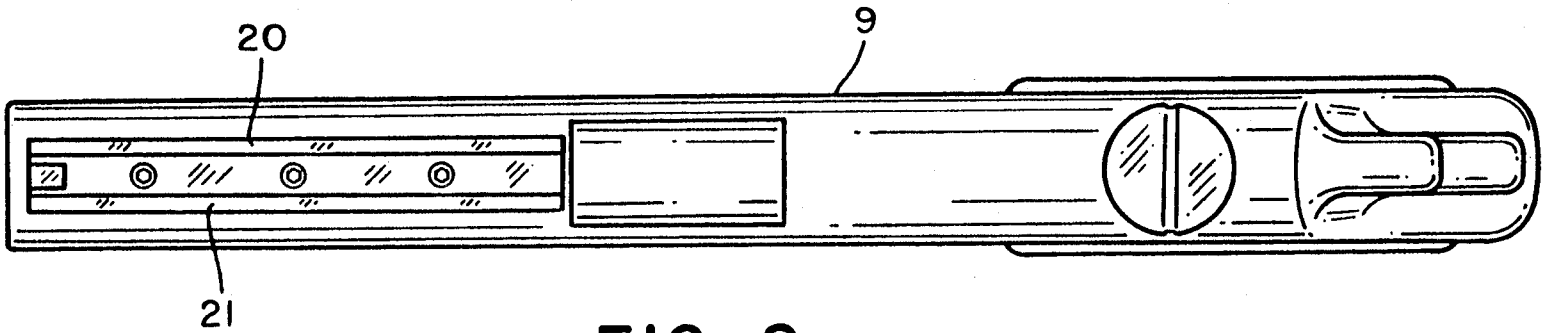
FIG. 2 is a top view of the sight of FIG. 1 mounted on the top of a hand gun having a light absorbing surface.

FIG. 2 illustrates the contrasting view presented to the shooter by the sights which are located on top of a weapon 9. Sight lines 20 and 21 vividly contrast with the weapon and are located on top of the channel rather than in the channel as shown in my U.S. Pat. No. 4,713,889. The location of the parallel sight lines on top of my channel sight rather than at the bottom of the channel has been found to permit the user to more quickly locate and align the target and the weapon since the sight lines are not in the shadow of the channel walls. Thus in the present sighting system the eyes are drawn to the reflective and highly visible sight lines located on top of the channel since there are no obstructions to distract the eyes or to obscure the target. The eyes can then be drawn into the bottom of my sighting channel whereas in my prior sight system with the sight lines located in the channel, the eyes are drawn into the bottom of the channel and then aligned around the sight post before a user can properly align the sights with the target. Since sight lines located in the bottom of the channel may be partially obscured by the sidewalls of the channels, the user may not be able to quickly align the sights with the target.

The present invention also permits the user to use the sight lines on the top of the channel as the sole means of aligning the sights with the target if the user has to shoot quickly and at close range.

Figure 3:
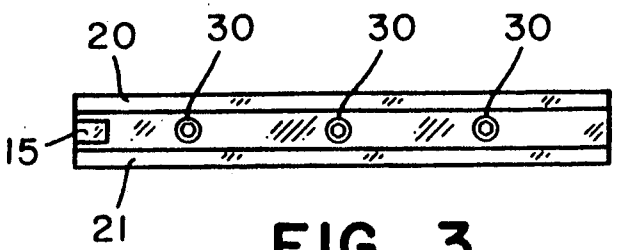
FIG. 3 is a top view of my sighting device illustrating the sight post and the means for mounting the sight to a weapon.

A reference to FIG. 3 illustrates a top view of channel sight 10 which illustrates that in a top view the front sight post 15 is visible but does not have a top reflecting surface as do surfaces 20 and 21 which form the sight lines. Sight line 20 and sight line 21 are identical in size and length and in their reflective appearance so as to not draw the user's eye to one sight line or the other sight lines. Sight lines 20 and 21 are approximately 1½ inches long and approximately slightly less than ⅛ inch wide. Sight lines 20 and 21 are shown spaced apart approximately ¼ inches to provide highly visible surfaces to permit the user to quickly zero in on the target once the sight lines are located. FIG. 3 also illustrates the openings 30 which permit one to mount sight 30 on top of a weapon.

Figure 4:
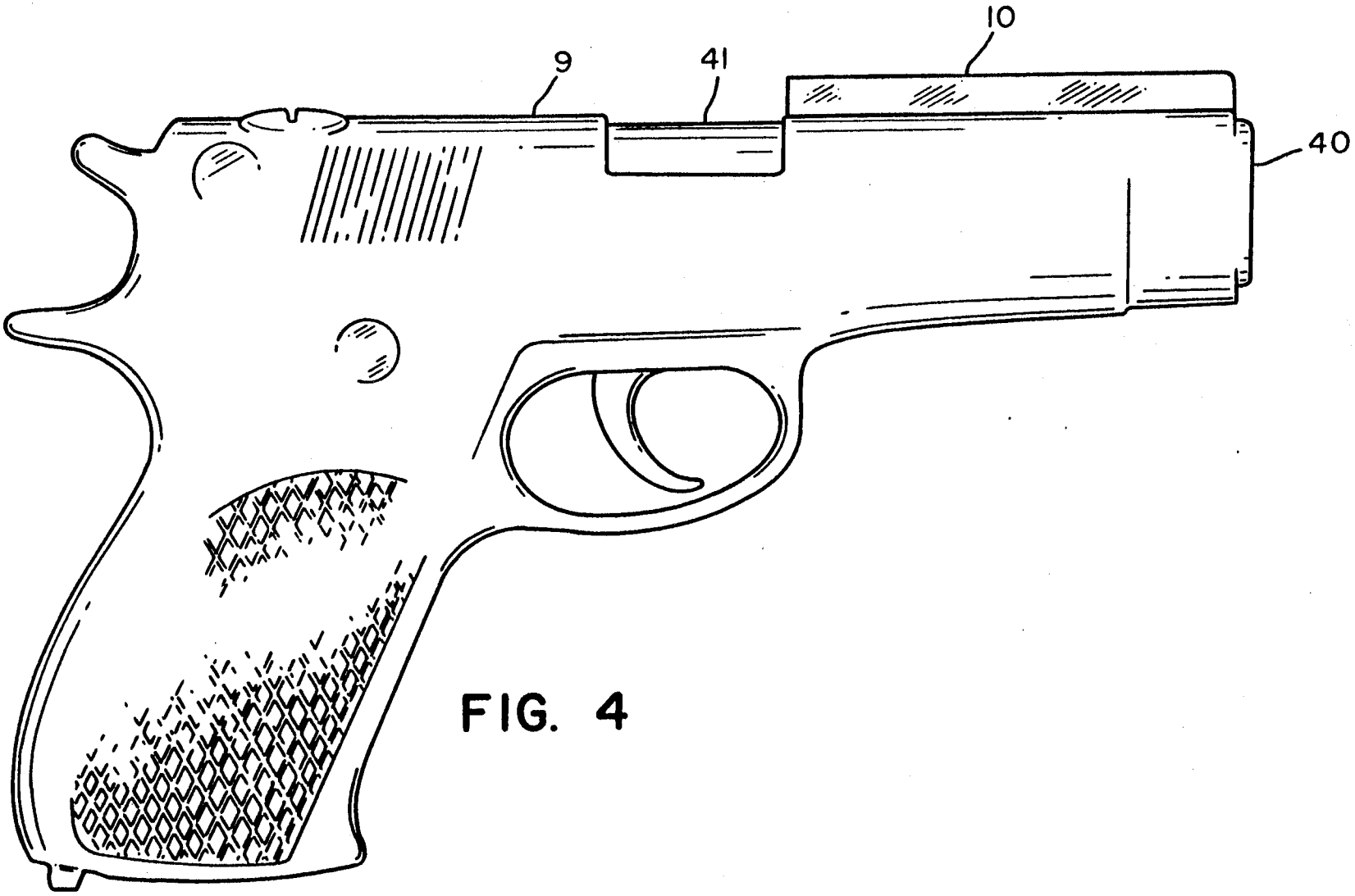
FIG. 4 is a side view of a hand gun having my channel sighting device located in front of the ejection port.

FIG. 4 shows a side view of an automatic hand gun with my channel sight located on the front portion of the barrel 40. A further feature of the present invention is that the sights are not required to be spaced at the front and rear of the handgun as with conventional post sights. FIG. 4 illustrates that my channel sight is only located on the portion of the barrel in front of the ejection port 41 thus permitting my channel sight to be used with automatic handguns with side ejection ports for spent casings.

Figure 5:
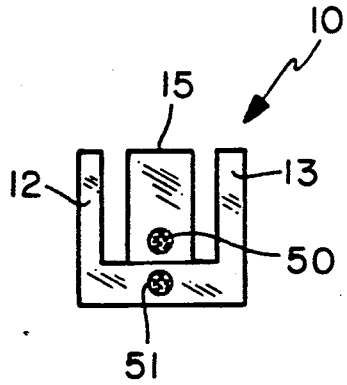
FIG. 5 is a rear view of the sighting device illustrating the use of luminescent sights to permit aiming and shooting under low-light conditions.

A further feature of the present invention is that my channel sight can be combined with illuminated sources to provide of night time shooting. FIG. 5 shows a rear view of my channel sight 10 with a radioluminescent dot sight 50 located on the back of front sight post 15 and a second radioluminescent dot sight 51 located on back end of channel sight 10. The radioluminescent sights are described in my U.S. Pat. No. 3,641,676. In my preferred embodiment I use a luminescent gas such as tritium or promethium in the dot sights to provide the necessary illumination for night time shooting. Although radioluminescent sights are preferred, other light sources could be used for providing illuminated sights for night time shooting. The circular or luminescent dot sights 50 and 51 have a diameter of approximately 0.080 inches and are positioned above and below the bottom of the channel. To properly align the illuminated sights with the target, the user moves sight 10 until the dot sights 50 and 51 appear as a figure eight. Thus the invention provides for rapid two-eye aiming and shooting under daytime conditions and if used with illuminated sight posts, also permits aiming and shooting under night time or low light conditions.

Figure 6:
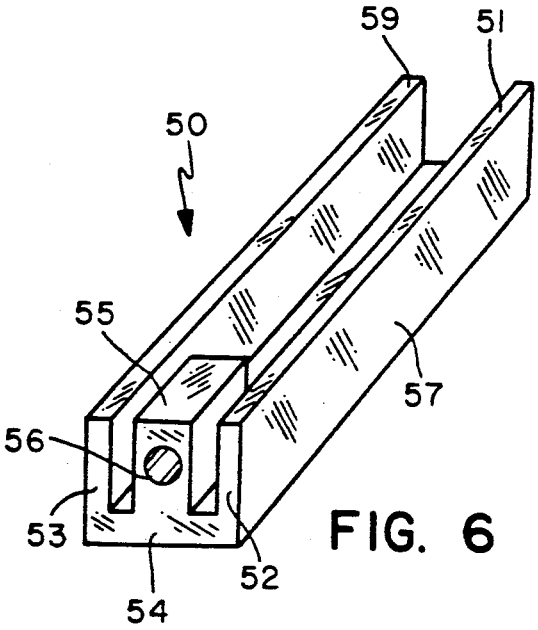
FIG. 6 is a perspective view of an alternate embodiment of my sighting device for mounting on top of a weapon.
Figure 7:
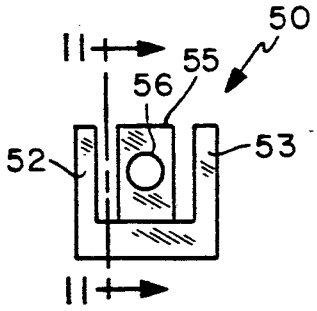
FIG. 7 is a rear view of the sighting device of FIG. 6 illustrating the use of an open hole through the front post.

Referring to FIGS. 6 and 7, reference numeral 50, identifies an alternate embodiment of my improved channel sight for mounting on a weapon for daytime and low level light or when the target is illuminated by artificial light. My sight comprises a U-shaped channel 50 formed by a first rectangular shaped sidewall 52, a bottom section 54 and a second rectangular shaped sidewall 53. Located on top of sidewall 52 is a light reflecting surface 51 and located on top of sidewall 53 is a light reflecting surface 59 which is parallel to light reflecting surface 53. Light reflecting surfaces 52 and 53 are located on the topmost portion of sight 50 and identical to the embodiment of FIG. 1 to provide prominent surfaces that contrast with the handgun to permit a user to quickly aim the weapon in daylight conditions without the user closing one eye. The embodiment of FIGS. 6 and 7 differ from the embodiment of FIG. 1 in that I have provided an opening 56 that extends through the front post 55, I have discovered that in low light conditions the use of a hole in the front sight provides background illumination to assist the shooter in lining the weapon with the target. The hole 56 is particularly useful when aiming a weapon at an illuminated object since light appears through opening 56 in the sight post, indicating that the user is on target. It should be pointed out that the opening is sufficiently small 0.086" in diameter so as not to provide a sight picture of an object but to merely display the lumination of the object the weapon is aimed at.

Figure 8:
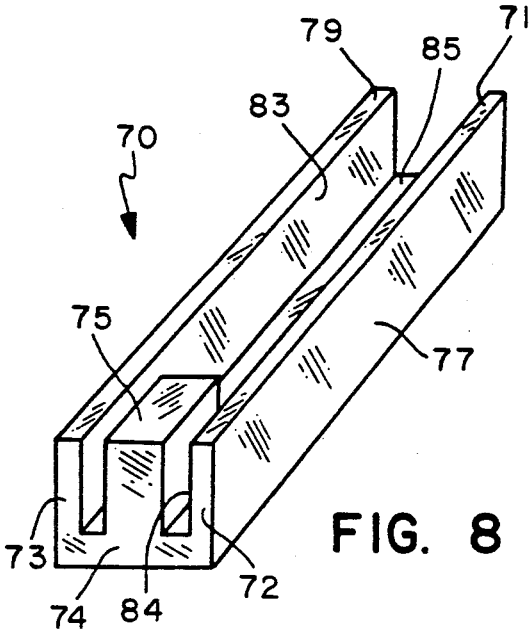
FIG. 8 is a perspective view of a further alternate embodiment of my sighting device for mounting on top of a weapon.
Figure 9:
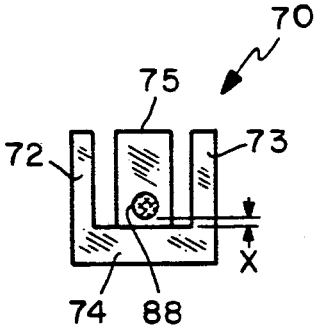
FIG. 9 is a rear view of the sighting device of FIG. 8 illustrating the use of a luminous sight with reflective sight channels.

Referring to FIG. 7 and 8 reference numeral 70 identifies my improved channel sight for mounting on a weapon. My sight comprises a U-shaped channel 70 formed by a first rectangular shaped sidewall 72, a bottom section 74 and a second rectangular shaped sidewall 73. Located on top of sidewall 72 is a light reflecting surface 71 and located on top of sidewall 73 is a light reflecting surface 79 which is parallel to light reflecting surface 72. Light reflecting surfaces 12 and 13 are located on the topmost portion of sight 10 and provide prominent surfaces that contrast with the handgun to permit a user to quickly aim the weapon in daylight conditions without the user closing one eye. Located on the inside of sidewall 73 is a light reflecting surface 83 and similarly located on the inside of sidewall 72 is a light reflecting surface 84. Similarly located on the bottom of sight 70 is a light reflecting surface 85. Typically, the light reflecting surfaces may be a polished metal surface. I have discovered that the use of interior reflective surfaces 83, 84, and 85 on the sight of FIG. 8 and FIG. 9 provides additional enhancement in aiming the weapon in nightime and low light conditions. That is, if the interior surfaces are polished to reflect light, and the user immediately sees the reflection of the luminescent dot 88 on the sidewalls or the bottom of the channel the user knows the sight is out of line. When the luminescent dot does not reflect off the sides or bottom of the sight back to the user, the user knows tat the weapon is aimed correctly. Luminescent dot 88 mounts a small distance from the bottom of channel 85, typically 0.01 inches. If the reflection is from the insides 83 or 84 the user knows the windage aim is incorrect. If the reflection is from the bottom of the channel 85 the user knows the elevation aim is incorrect. When the single dot appears with the target and without reflection the weapon is properly aimed. The length of my channel sight is determined by the desired accuracy of the sight. That is, with a longer sight channel one can obtain greater shooting accuracy than with shorter sight channels. In most applications a sight length of approximately 4 inches provides a preferred accuracy.

Figure 10:
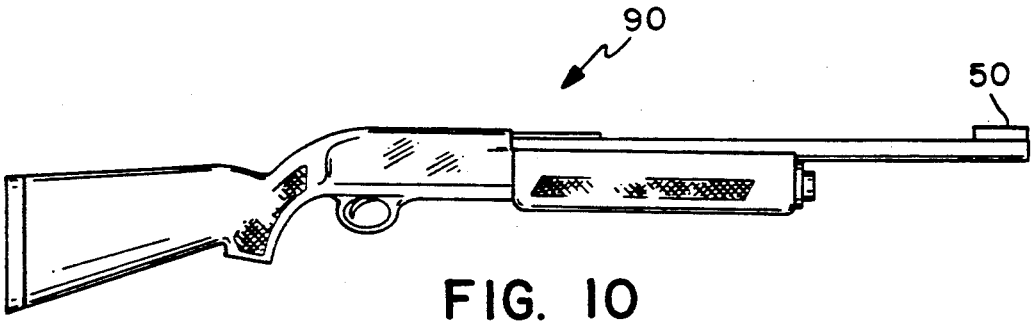
FIG. 10 is a side view of a sighting device mounted on a shotgun.

FIG. 10 shows my sight 50 mounted by a support 91 to a shotgun 90.

FIGS. 11-19 shows an alternate embodiment of my invention that permits a user to place different colored disposable inserts in the opening in my single front sight post. The purpose of using different colored sights is to permit the user to select the proper color sight for the target. For example if one were hunting brown bear one could place a sight insert of contrasting color in the sight post to provide sharp contrast between the target and the sight post insert. When viewing the gunsight of the present invention it is apparent that there are two side channels with a single front sight post located between the side channels at the front most portion of the gunsight.

Figure 11:
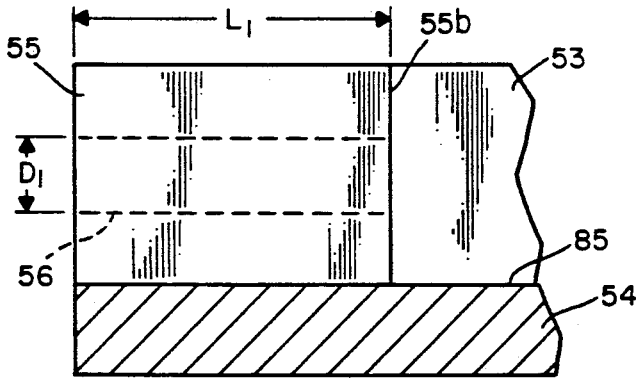
FIG. 11 is a side view of the sight post in my sights.

FIG. 11 shows a partial sectional view taken along lines 11 of FIG. 7 to illustrate the single sight post used in the present invention. Sight post 55 includes an elongated cylindrical opening 56, which is parallel tot he bottom surface 85 of my channel sight. The diameter of the opening in post 55 is designated as D1. It is this opening 55 where a user can install or insert eh appropriate color so that the sight post insert contrast with the target. In the preferred embodiment I utilize inserts that are made of translucent material so that they pick up light from the region in front of the gunsight. Typical translucent materials are polymer plastics. The use of a translucent or light conducting material functions to direct light from in front of the sight into the rear of the insert that is located between the sidewalls. The result is that the end of the translucent material appears as if it contained a colored light source.

Figure 12:
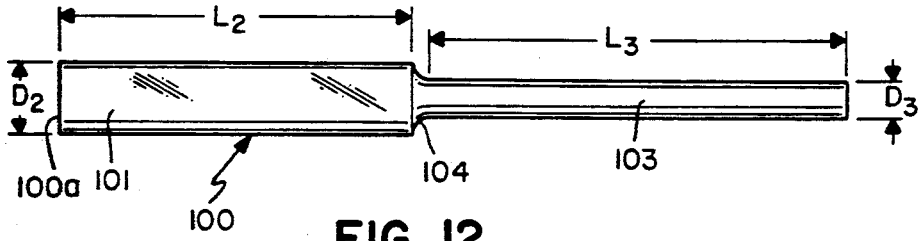
FIG. 12 is a side view of a disposable insert for sight post.

FIG. 12 shows a translucent sight insert 100 for insertion into opening 56 and then cut to fit the sight post. Translucent insert 100 is made from a translucent and resilient material such as a polymer plastic or the like. Insert 100 comprises a cylindrical base 101 of diameter D2 and a tongue 103 of diameter D3. Diameter D2 is slightly smaller than dimension D1 so that when the base 101 is inserted into opening 56 it forms a tight frictional fit in opening 56. The cylindrical base has a dimension L2 which is slightly longer than the length of opening L1 in sight 55. The longer length insures that when the user cuts the insert t length the insert located in the opening 55 will uniformly fill opening 56. Tongue 103 also has a dimension L3 which is also longer than the dimension L1. The use of a tongue 103 that is longer than the opening 56 permits a user to quickly and easily insert one end of the smaller diameter tongue completely through the sight post by allowing the user to pull the base portion 101 into opening 56 rather than pushing the base portion into opening 101. That is, if the cylindrical base is somewhat resilient pushing the base into the opening would produce a diametrical expansion of the base as the base is pushed into the opening. On the other hand a pulling of the base produces a narrowing of the diametrical base thus easing the insertion of the base into the opening 56.

Figure 13:
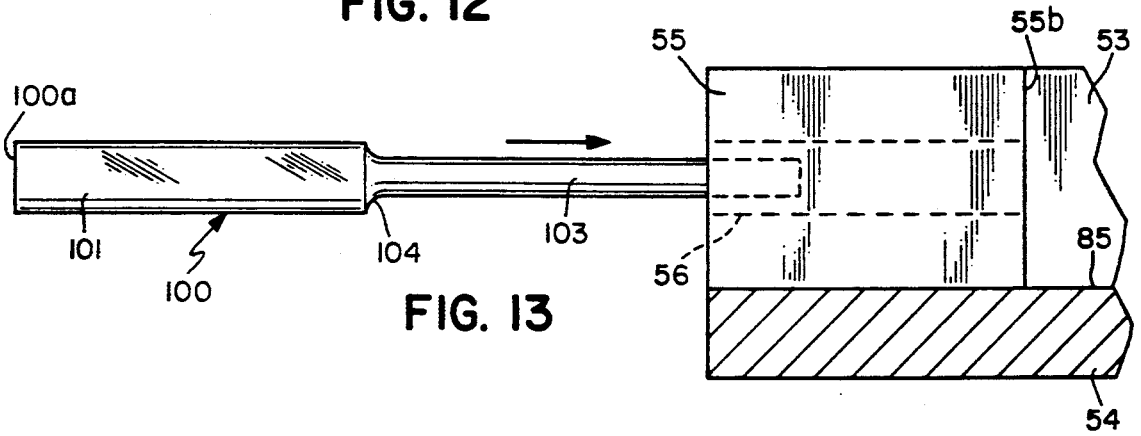
FIG. 13 illustrates a disposable insert being inserted into the opening in my sight post.
Figure 14:
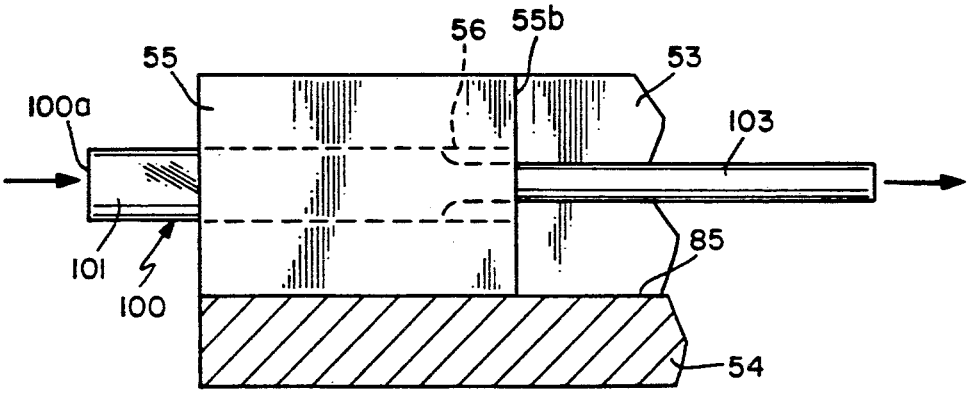
FIG. 14 shows a disposable insert being pulled into the opening in my sight post.
Figure 15:
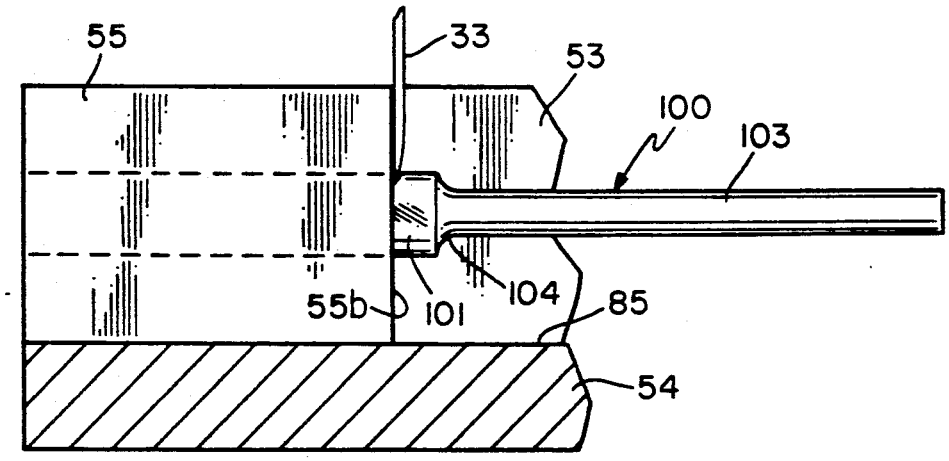
FIG. 15 shows my disposable insert located in the sight post.
Figure 16:
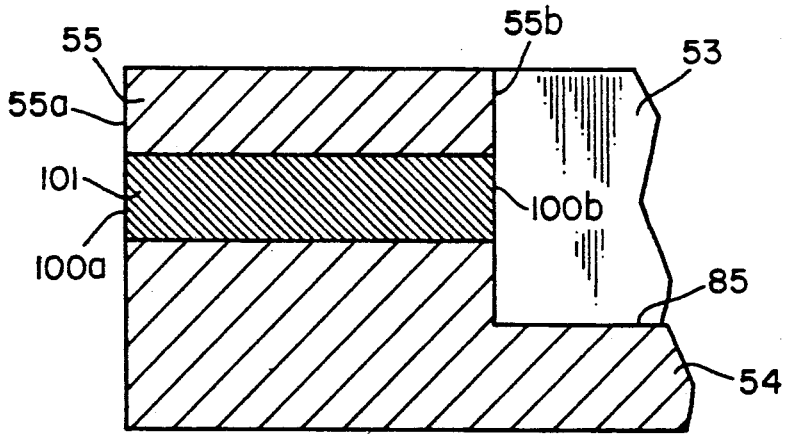
FIG. 16 shows my sight post with the end of the disposable sight cut flush with the end of the sight post.

In order to understand how one inserts a translucent sight insert into opening 56 reference should be made to FIGS. 13 to 16. FIG. 13 shows the narrower or tongue end 103 of insert 100 partially inserted into opening 56. (indicated by arrow) Once the end of tongue 103 extends through opening 56 the user grasps and pulls on the end of tongue 103 to pull base 101 into position as illustrated by FIG. 14 and FIG. 15.

Once the translucent sight insert is pulled into place as shown in FIG. 15 a user takes a knife 33 and cuts off the end of base 101 to leave cut base 101 as an insert in post 55. Note, after cutting one end of insert 101 is flush with sight post front surface 55*a* and the other end of insert 101 is flush with sight post 55*b* rear surface.

The insert 101 is shaded to indicate the color green. A green insert permits the user to have a sight post that contrasts with a target having a different color. For example if the user was shooting at a brown target.

Figure 17:
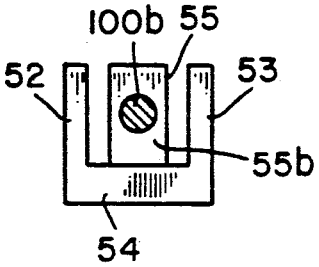
FIG. 17 shows an end view of my sight post with the disposable insert.

FIG. 17 shows how sight post 55 with end 100*b* of cylindrical base contrasting with sight post 55 when the user aims the weapon with my gunsight.

Figure 18:
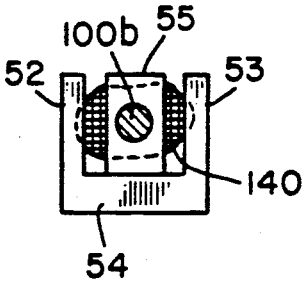

FIG. 18 illustrates how a black target 140 might appear to a shooter as the shooter sights in on the black target using the translucent sight insert 100*b* to aim at the target. The use of the translucent sight inserts permits the user to pick up light from in front of the gunsight so that the insert contrasts with the region directly behind the sight post that is the area partially shaded by the channel sidewalls and the sight post.

If the user wishes to change the sight insert he or she merely pushes out the old insert 100 and inserts the new insert 110 in opening 55.

Figure 19:
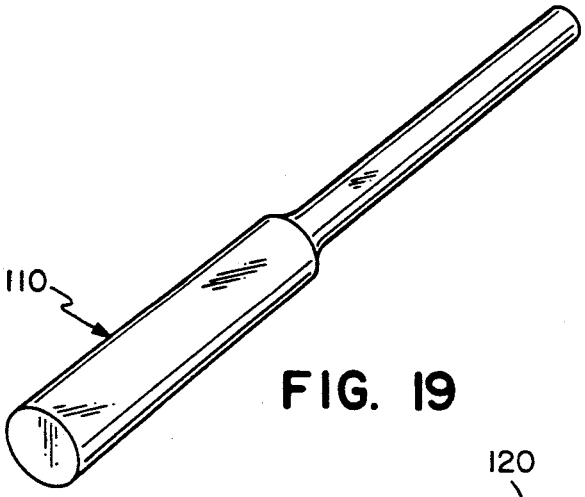
FIG. 19 shows another color disposable insert for replacing one disposable insert with another disposable insert.

FIG. 19 shows a sight insert 110 that is identical in size to sight insert 100 except sight insert 110 is a different color than sight insert 100.

Figure 20:
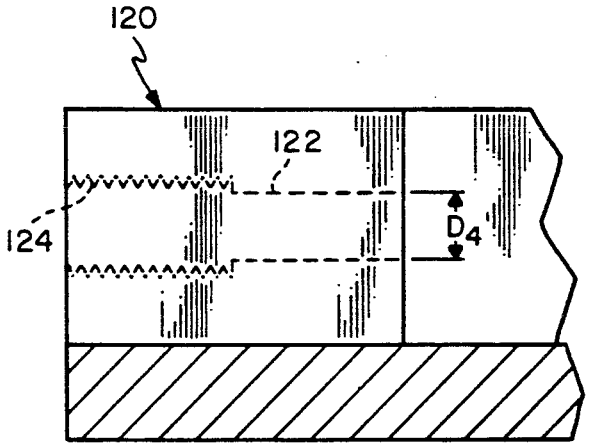
FIG. 20 shows a sight post for receiving a reusable insert.
Figure 21:
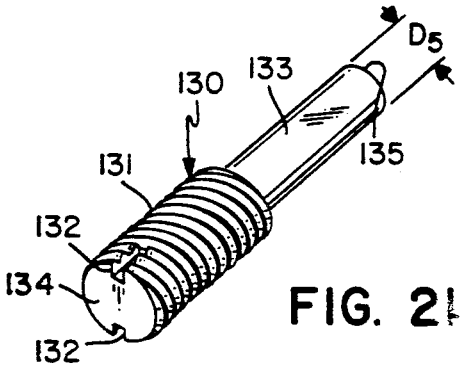
FIG. 21 shows a reusable insert for use with the sight post of FIG. 20.
Figure 22:
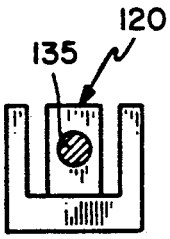
FIG. 22 shows an end view of my sight with a reusable insert.

FIG. 20–22 show a still further embodiment of my invention that uses a reusable translucent insert that is made from a material such as acrylic. An example of a material is a polymeric plastic such as Lexan. The embodiment of FIG. 20 differs from the embodiment of FIG. 12 since the insert need not be made of resilient material. FIG. 20 illustrates a sight post 120 that is identical to sight post 55 except that the opening in sight post 120 is stepped and includes threads for threadingly inserting or removing a threaded translucent insert. Sight post 120 includes a first larger diameter opening having threads 124 and a smaller diameter cylindrical straight section 122 of diameter D4.

The reusable translucent insert 130 is shown in FIG. 21 and comprises a threaded section 131 for engaging threads 124 and a cylindrical section 133 of diameter D5 for fitting into cylindrical opening 122 in sight 120. Located on the end face 134 are notches 132 that permit a user with a spanner type wrench to screw sight insert 130 into position in sight post 120. Insert 130 is preferably made from a hard polymer plastic and does not require the resiliency of the material to hold the insert in place since the threads both hold the insert in place and permit a user to replace the insert as needed.

FIG. 22 illustrates how the end 135 of insert 130 is visible to a user who is aiming at a target. Note the notches 132 are not visible since the diametrical dimension between notches 132 is less than the diameter D4 of opening 122. Also the opening D4 and the diameter D5 of member 133 are within a couple thousands of an inch to permit the section 133 to fit snugly into the opening 122.

In the present invention I prefer to mount my sighting device on the end of a shotgun with the sighting device having an overall dimension of about four inches. I have found that a sight length of about four inches is ideal for most shoulder weapons since it provides sufficient sight length to permit the user to accurately aim the weapon. I do not need a rear sight since the elongated channel directs the shooters eye along the channel member and around the single sight post located in the front of the gunsight. As illustrated in FIG. 18 the shooter typically sees two rectangular shaped regions on each side of the sight post. By sighting along the channel and around the sight post the shooter can locate the target with respect to the channel and the sight post. The colored insert which picks up light from the region in front of the sight permits the user to easily see the contrast between the colored insert and the target thus assisting in alignment of the sights with the target.

Figure 23:
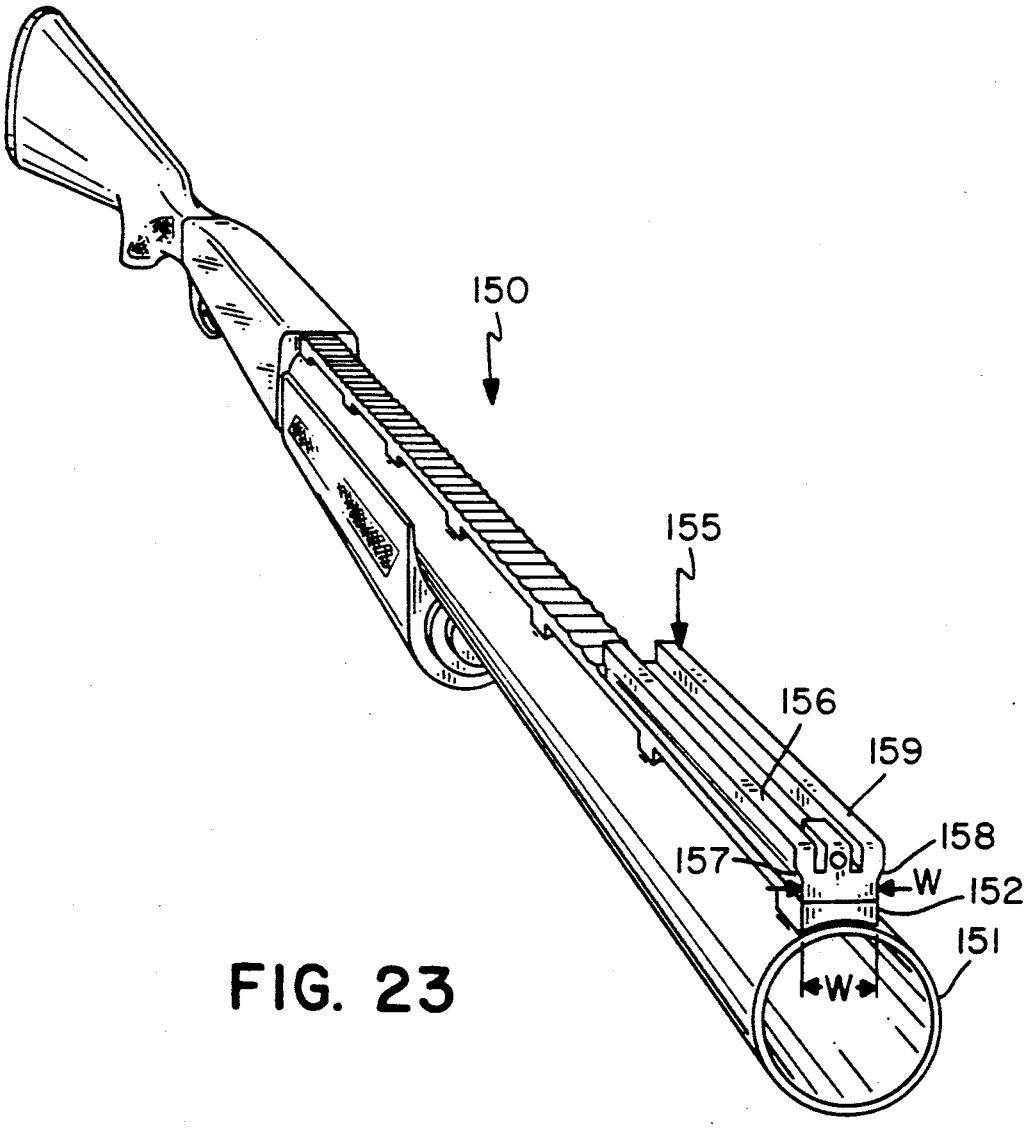
FIG. 23 is a pictorial view of my sight on a vent rib shotgun.

Referring to FIG. 23 reference numeral 150 shows my channel sight 155 located on a vent rib shotgun. The channel sight 155 includes a side channel 156 that has a face 157 that tapers inward to mate with the rib 152 located on barrel 151. Similarly, side channel 159 includes a face 158 that tapers inward to mate with rib 152. The reference letters W denote that the width of the bottom of channel sight 155 and rib 152 are the same dimension so that the channel sight 155 blends into the vent rib to permit more air around the sight for wing shooting. The use of a sight that has a width the same as the vent rib also permits the sight to be self aligning as one mounts the sight to the rib preferably through screws or the like.

I claim:

1. A two position sighting device for mounting on the top of a weapon to permit either quick shooting alignment or more precise alignment with a target without the user having to close one eye comprising:

a weapon having a front region and a rear region proximate a person aiming the weapon;

a channel member mounted on only the front region of said weapon so that a person aiming the weapon can sight an object with only said channel member on said front region of said weapon;

said channel member having a front and a rear, said channel member having a first sidewall extending upward, said first sidewall having a first surface extending upward, said first sidewall having a first topmost light reflective sighting surface thereon to form a first eye attracting sight line;

said channel member having a second sidewall extending upward, said second sidewall having a first surface extending upward, said second sidewall having a second topmost light reflective sighting surface thereon to form a second eye attracting sight line, said first light reflective sighting surface parallel to said second light reflective sighting surface so that said first eye attracting sight line and said second eye attracting sight line on said topmost light reflecting surfaces provide a quick sighting position to quickly guide the users eye into initial quick shooting alignment with a target;

said channel member having a bottom section connecting said first sidewall to said second sidewall, said first surface of said first sidewall and said first surface of said second sidewall forming an open sighting channel with no obstructions to the user viewing said first surface of said first sidewall and said first surface of said second sidewall from a sighting position behind the rear of said channel member;

a sight post extending upward from said bottom section, said sight post located at the front of said channel member, said sight post spaced between said first surface of said first sidewall and said first surface of said second sidewall, said sight post and said sidewalls forming a more precise sighting position to thereby enable a user to precisely aim a weapon attached to said two position sighting device by sighting along said bottom section in said channel and around said sight post.

* * * * *